US005165879A

United States Patent [19]

Kondo et al.

[11] Patent Number: 5,165,879

[45] Date of Patent: Nov. 24, 1992

[54] SCROLL TYPE FLUID MACHINERY WITH DRIVING PIN IN BUSHING SLIDE GROOVE

[75] Inventors: Hiroaki Kondo, Nishikasugai; Takahisa Hirano, Nagoya; Takayuki Iio, Nishikasugai, all of Japan

[73] Assignee: Mitsubishi Jukogyo Kabushiki Kaisha, Tokyo, Japan

[21] Appl. No.: 707,665

[22] Filed: May 30, 1991

[30] Foreign Application Priority Data

Aug. 30, 1990 [JP] Japan ..... 2-91045[U]
Aug. 31, 1990 [JP] Japan ..... 2-91215[U]

[51] Int. Cl.[5] ..... F01C 1/04; F01C 17/06
[52] U.S. Cl. ..... 418/55.5; 418/57
[58] Field of Search ..... 418/55.5, 57

[56] References Cited

U.S. PATENT DOCUMENTS 4,435,137 3/1984 Terauchi ..... 418/57
4,764,096 8/1988 Sawai et al. ..... 418/55.5
4,808,094 2/1989 Sugimoto et al. ..... 418/55.5
5,040,958 8/1991 Arata et al. ..... 418/55.5

FOREIGN PATENT DOCUMENTS 3911882 10/1989 Fed. Rep. of Germany .
59;120794 7/1984 Japan .
2-45672 2/1990 Japan ..... 418/55.5
2-016383 3/1990 Japan .
2176179 7/1990 Japan ..... 418/57
2191246 12/1987 United Kingdom .

*Primary Examiner*—John J. Vrablik

[57] ABSTRACT

A scroll type fluid machinery has a stationary scroll and a revolving scroll having spiral wraps set up on inner surfaces of respective end plates in engagement with each other. A drive bushing is inserted rotatably into a boss which is projected at a central part of an outer surface of the end plate of the revolving scroll. An eccentric driving pin of a rotary shaft is fitted slidably into a slide groove bored through the drive bushing. A gap between one end of the slide groove in a direction that the radius of revolution becomes larger and the eccentric driving pin is set to a preset very small distance δ (here, δ is a value determined based on processing error, deformation due to temperature and pressure and the like of the above-mentioned respective scrolls) when the revolving scroll occupies a position of theoretical radius of revolution thereof. With this, it is possible to prevent the drive bushing from tiltably rotating beyond what has been predetermined while the revolving scroll is revolving.

6 Claims, 3 Drawing Sheets

SCROLL TYPE FLUID MACHINERY WITH DRIVING PIN IN BUSHING SLIDE GROOVE

FIELD OF THE INVENTION AND RELATED ART STATEMENT

The present invention relates to a scroll type fluid machinery used as a compressor, an expansion machine and the like.

FIG. 4 and FIG. 5 show an example of a conventional scroll type compressor.

As shown in FIG. 5, a scroll type compression mechanism C is disposed in an upper part in a closed housing 8 and an electric motor 4 is disposed in a lower part thereof, and these are connected interlockingly with each other by means of a rotary shaft 5.

The scroll type compression mechanism C is provided with a stationary scroll 1, a revolving scroll 2, a mechanism 3 for checking rotation on its axis such as an Oldham's link and the like which allows revolution in a solar motion but checks rotation on its axis, a frame 6 fitted with the stationary scroll 1 and the electric motor 4, an upper bearing 71 and a lower bearing 72 supporting the rotary shaft 5, a rotary bearing 73 which supports the revolving scroll 2, a thrust bearing 74 and the like.

The stationary scroll 1 consists of an end plate 11 and a spiral wrap 12 which is set up on an inner surface of the end plate 11, and a discharge port 13 and a discharge valve 17 which opens and closes the discharge port 13 are provided on the end plate 11.

The revolving scroll 2 consists of an end plate 21, a spiral wrap 22 which is set up on an inner surface thereof, and a boss 23 projected at a central part on the outer surface of the end plate 21. A drive bushing 54 is inserted into the boss 23, and is supported rotatably through the rotary bearing 73. Further, a slide groove 55 is bored through the drive bushing 54 as shown clearly in FIG. 4, and an eccentric driving pin 53 is fitted slidably in a direction shown with an arrow mark in the slide groove 55 along the longitudinal direction thereof. The eccentric driving pin 53 is projected above the upper end surface of the rotary shaft 5 and extends upward, and a center $O_2$ thereof is made to be eccentric from a shaft center $O_1$ of the rotary shaft 5 by a predetermined distance r (radius of revolution in a solar motion of the revolving scroll 2). Further, a balance weight 84 for balancing dynamic unbalance due to revolution in a solar motion of the revolving scroll 2 is fixed at the lower end part of the drive bushing 54, and lower end surfaces of these drive bushing 54 and the balance weight 84 are made to be in contact slidably with the upper end surface of the rotary shaft 5.

A lubricating oil 81 stored at a bottom part of the housing 8 is sucked up through an inlet port 51 by a centrifugal force generated by rotation of the rotary shaft 5, passes through an oil filler port 52 and lubricates the lower bearing 72, the upper bearing 71 and the like. Thereafter, the lubricating oil is discharged to the bottom part of the housing 8 through a chamber 61 and a discharge port 62.

When the electric motor 4 is driven, the rotational torque thereof is transmitted to the revolving scroll 2 through the rotary shaft 5, the eccentric driving pin 53, the drive bushing 54 and the rotary bearing 73, and the revolving scroll 2 revolves in a solar motion while being checked to rotate in its axis by means of the mechanism 3 for checking rotation on its axis.

Then, after a gas enters into the housing 8 through a suction pipe 82 and cools the electric motor 4, the gas is suctioned into a plurality of closed spaces 24 which are delimited by having the stationary scroll 1 and the revolving scroll 2 engaged with each other from a suction passage 15 through a suction chamber 16. Then, as the volume of the closed spaces 24 decreases by revolution in a solar motion of the revolving scroll 2, the gas reaches a central part while being compressed, passes through the discharge port 13, pushes up the discharge valve 17 and is discharged to a discharge cavity 14. Furthermore, the gas enters into a second discharge cavity 19 through a hole 18 which is bored through a partition wall 31, and is discharged outside through a discharge pipe 83 therefrom.

On the other hand, a centrifugal force toward an eccentric direction and a gas force generated by a compression gas in the closed spaces 24 act on the revolving scroll 2 at the time of revolution in a solar motion of the revolving scroll 2, and the revolving scroll 2 is pushed by the resultant force in a direction of increasing the radius of revolution thereof, and the side surface of the wrap 22 comes in close contact with the side surface of the wrap 12 of the stationary scroll 1, thereby to check leakage of the gas in the closed spaces 24. Then, when the side surface of the wrap 12 and the side surface of the wrap 22 rub each other while being in close contact with each other, the radius of revolution of the revolving scroll 2 changes automatically, and the eccentric driving pin 53 slides in the slide groove 55 along the longitudinal direction thereof in keeping with the above. Further, the lower end surfaces of the drive bushing 54 and the balance weight 84 slide on the upper end surface of the rotary shaft 5.

In the above-mentioned scroll type compressor, an axial position of the center of gravity G of the balance weight 84 is located at a lower part in an axial direction of the drive-bushing 54, and further, the drive bushing 54 and the balance weight 84 are placed on the upper end surface of the rotary shaft 5, and the eccentric driving pin 53 is only fitted slidably into the slide groove 55. Accordingly, the balance weight 84 and the drive bushing 54 which is formed in one body therewith rotate with a gradient (i.e. tilt) clockwise in FIG. 5 by a centrifugal force acting on the center of gravity of the balance weight 84 at the time of revolution in a solar motion of the revolving scroll 2. In other words, when rotary shaft 5 is rotated, centrifugal force is generated which would tend to tilt the drive bushing 54 (rotate the drive bushing 54 clockwise in FIG. 5). Therefore, as the drive bushing 54 would tend to be tilted, the connected balance weight 84 would tend to move upwardly toward mechanism 3. As a result, there has been such a problem that offset working is brought about on the rotary bearing 73, and offset working is also brought about between the lower end surface of the drive bushing 54 and the upper end surface of the rotary shaft 5.

OBJECT AND SUMMARY OF THE INVENTION

It is an object of the present invention which has been made in view of such point to provide a scroll type fluid machinery for solving the above-described problems.

In order to achieve the above-mentioned object, the gist of the present invention is described in the following items (1) and (2).

(1) There is provided a scroll type fluid machinery, in which a stationary scroll and a revolving scroll having spiral wraps set up on inner surfaces of respective end plates are engaged with each other, a drive bushing is inserted rotatably into a boss which is projected at a central part of an outer surface of the end plate of the revolving scroll, and an eccentric driving pin projecting from a rotary shaft is fitted slidably into a slide groove bored through the drive bushing, characterized in that a gap between one end of the slide groove in a direction that the radius of revolution becomes larger and the eccentric driving pin is set to a preset very small distance δ (here, δ is a value determined based on processing error, deformation due to temperature and pressure and the like of above-mentioned respective scrolls) when the revolving scroll occupies a position of theoretical radius of revolution thereof.

Furthermore, a scroll type fluid machinery of the present invention is characterized in that a gap between one end of the slide groove in a direction that the radius of revolution of the revolving scroll becomes smaller and the eccentric driving pin is set at an interval which is sufficient for allowing foreign matter which have been engaged inbetween wraps of both scroll wraps and the fluid suctioned into closed spaces formed between both scrolls to escape therethrough.

According to the present invention, since the above-described construction is provided, one end of the slide groove abuts against the eccentric driving pin when the drive bushing is going to rotate with a gradient, thus making it possible to keep the drive bushing from tilting (i.e. from further rotation with a gradient).

As a result, it is possible to prevent offset working of a rotary bearing which supports the drive bushing and offset working between the end surface of the drive bushing and the end surface of the rotary shaft.

(2) There is provided a scroll type fluid machinery, in which a stationary scroll and a revolving scroll having spiral wraps set up on inner surfaces of respective end plates are engaged with each other, a drive bushing is inserted rotatably into a boss which is projected at a central part of an outer surface of the end plate of the revolving scroll, and an eccentric driving pin projecting from a rotary shaft is fitted slidably into a slide groove bored through the drive bushing, characterized in that a stopper which abuts against the end surface of the drive bushing so as to control rotation with a gradient (tilting) thereof is provided at a point of the eccentric driving pin.

According to the present invention, since the above-described construction is provided, an end surface of the drive bushing abuts against the stopper when it is going to rotate with a gradient (i.e. tends to tilt), thus making it possible to control the rotation with a gradient thereof.

As a result, it is possible to prevent offset working of the rotary bearing which supports the drive bushing and offset working between the end surface of the drive bushing and the end surface of the rotary shaft. Accordingly, it is possible to prevent abnormal wear and damage based on the above, thereby improving reliability of a scroll type fluid machinery.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more full understood from the detailed description given hereinbelow and the accompanying drawings which are given by way of illustration only, and thus are not limitative of the present invention, and wherein:

FIG. 1 and FIG. 2 show a first embodiment of the present invention, wherein FIG. 1 is a partial longitudinal sectional view and FIG. 2 is a partial plan view;

FIG. 4 and FIG. 5 show an example of a conventional scroll type compressor, wherein FIG. 4 is a partial plan view and FIG. 5 is a longitudinal sectional view.

DETAILED DESCRIPTION OF THE PREFERRED EMBODIMENTS

Preferred embodiments of the present invention will be described in detail hereafter illustratively with reference to the drawings.

Figure 1:
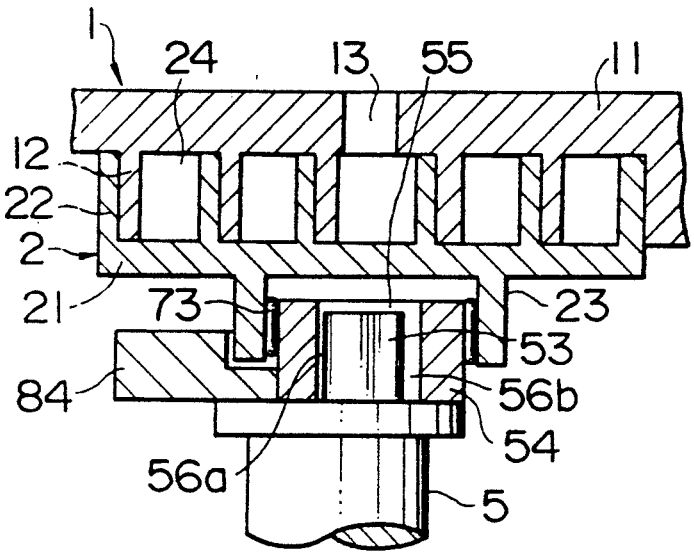
Figure 2:
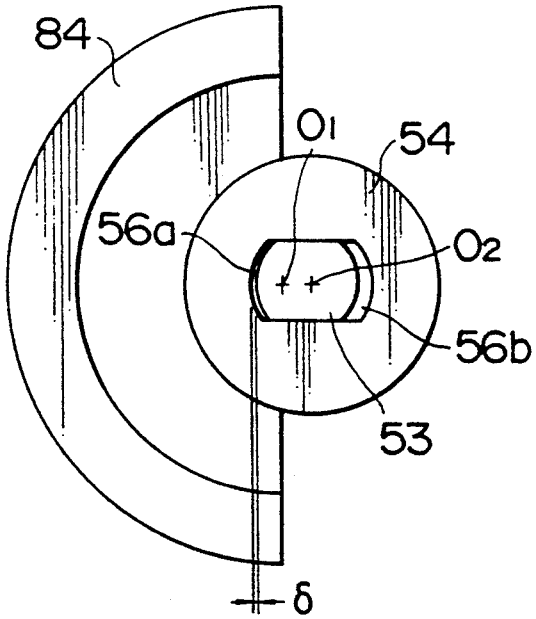

The first embodiment:

FIG. 1 and FIG. 2 show a first embodiment of the present invention.

In FIG. 1 and FIG. 2, a state in which a revolving scroll occupies a position of theoretical radius of revolution thereof is shown. In this state, a gap between one end of a slide groove 55 and an eccentric driving pin 53, viz., a gap **56*a* in a direction that the radius of revolution of a revolving scroll 2 becomes larger is set to a preset very small distance δ. Besides, the very small distance δ is approximately several ten microns long, and is determined experimentally based on processing errors, deformation due to temperature and pressure and the like of a stationary scroll 1 and a revolving scroll 2, and such a value that does not become larger any more even if the revolving scroll 2** slides in a direction that the radius of revolution becomes larger than the theoretical radius of revolution thereof is selected.

Incidentally, the interval of the gap **56*b* in a direction that the radius of revolution of the revolving scroll 2 becomes smaller is set at an interval which is sufficient to allow foreign matter engaged between wraps 12 and 22 and the fluid suctioned into the closed spaces 24** to escape therefrom similarly to a conventional interval.

The revolving scroll 2 can slide in a direction that the radius of revolution becomes larger within the range of the very small distance δ. Thus, the wrap 22 and the wrap 12 are able to come in close contact with each other even if there are processing errors, deformation due to temperature and pressure and the like of the stationary scroll 1 and the revolving scroll 2.

On the other hand, when the drive bushing 54 tends to tilt due to a centrifugal force acting on the balance weight 84 and the eccentric driving pin 53 comes in contact with one end of the slide groove 55 in a direction that the radius of revolution becomes larger at the time of revolution in a solar motion of the revolving scroll 2, the drive bushing 54 no longer tends to tilt.

As it is apparent from the above-described description, a gap between one end of the slide groove in a direction that the radius of revolution become larger and the eccentric driving pin is set at a preset very small distance δ when the revolving scroll occupies a position of theoretical radius of revolution thereof in the present embodiment. Therefore, since one end of the slide groove abuts against the eccentric driving pin when the drive bushing is going to rotate tiltably, it is possible to prevent further tilting.

Figure 3:
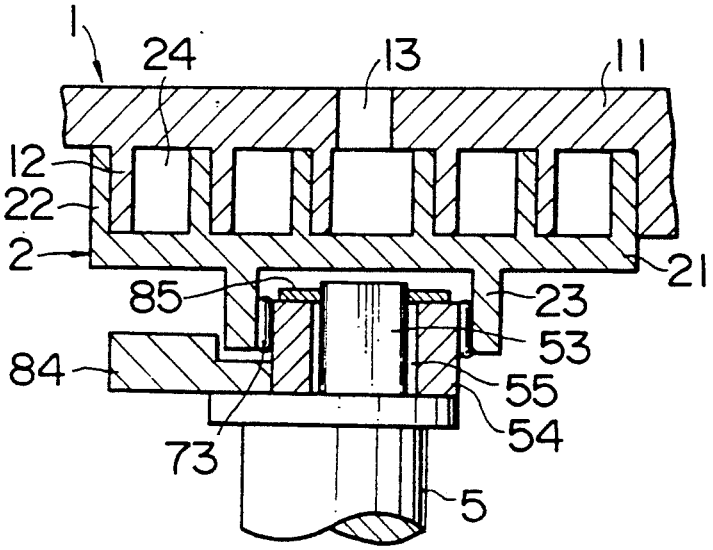
FIG. 3 is a partial longitudinal sectional view showing a second embodiment of the present invention.

The second embodiment:

FIG. 3 shows a second embodiment of the present invention.

A plate-shaped stopper 85 is screwed in and fitted by caulking, clipping and the like at the point of the eccentric driving pin 53.

Further, when the drive bushing 54 is going to tiltably rotate, the underside of the stopper 85 abuts against the upper end surface of the drive bushing 54 so as to control tilting of the drive bushing 54.

Figure 4:
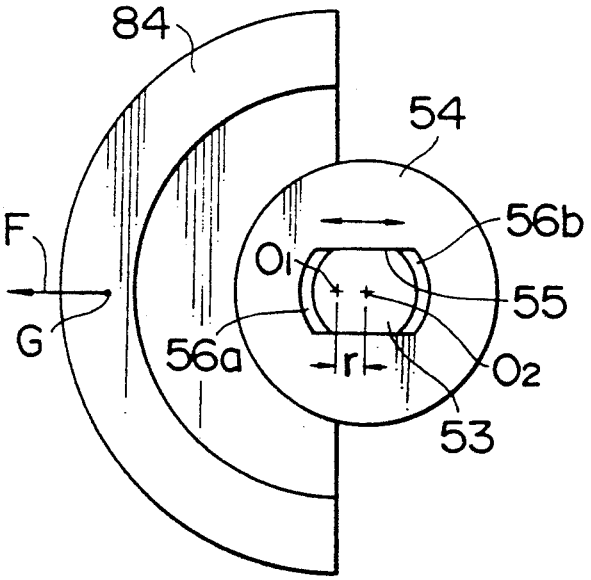
FIG. 4 PRIOR ART
Figure 5:
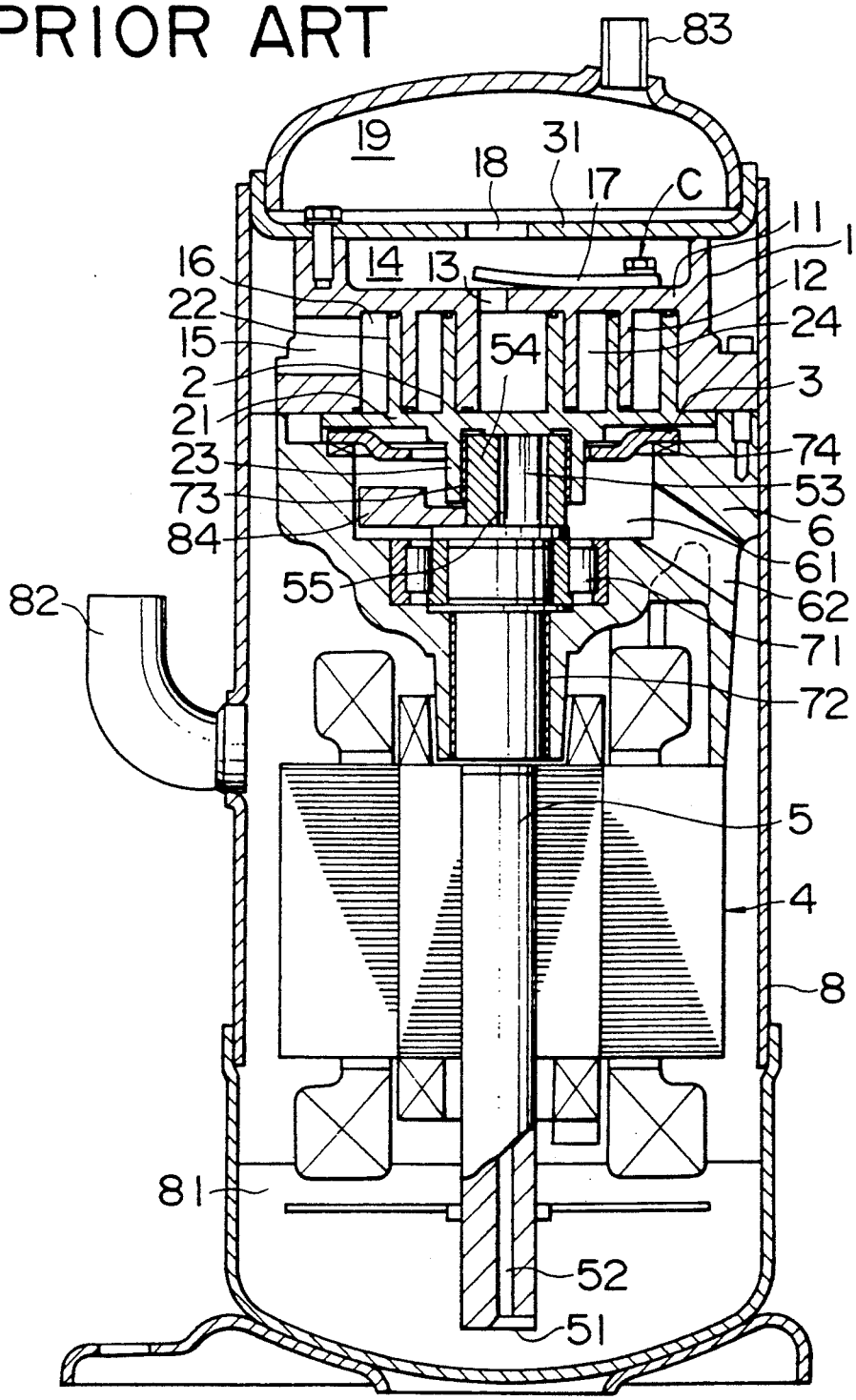
FIG. 5 PRIOR ART

Other construction and operation are similar to those in a conventional machinery that are shown in FIG. 4 and FIG. 5, and the same symbols are assigned to corresponding members and description thereof is omitted herein.

As it is apparent from the above description, since a stopper which abuts against the end surface of the drive bushing so as to control rotation with a gradient thereof is provided at a point of the eccentric driving pin in the present embodiment, it is possible to control tilting of the drive bushing.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A scroll type fluid machinery, comprising a stationary scroll and a revolving scroll having spiral wraps set up on inner surfaces of respective end plates thereof, the stationary and revolving scrolls being engaged with each other, a drive bushing being inserted rotatably into a boss which is projected at a central part of an outer surface of the end plate of said revolving scroll, an eccentric driving pin projecting from a rotary shaft being slidably fitted into a slide groove bored through the drive bushing, and a gap between one end of said slide groove in a direction that the radius of revolution becomes larger and said eccentric driving pin being set to a preset very small distance $\delta$, wherein $\delta$ is a value determined when said revolving scroll occupies a position of theoretical radius of revolution thereof and is based on processing error, and based on deformation due to temperature and pressure of the scrolls, the gap preventing tilting of the drive bushing beyond a certain amount as determined by the preset distance $\delta$.

2. The scroll type fluid machinery according to claim 1, further comprising a gap between one end of said slide groove in a direction that the radius of revolution of said revolving scroll becomes smaller and said eccentric driving pin, the gap being set at an interval which is sufficient for allowing abnormal matter which is engaged between wraps of both of said scroll wraps and fluid suctioned into closed spaces formed between both of said scrolls to thereby escape therethrough.

3. A scroll type fluid machinery, comprising a stationary scroll and a revolving scroll having spiral wraps set up on inner surfaces of respective end plates thereof, the stationary and revolving scrolls being engaged with each other, a drive bushing being inserted rotatably into a boss which is projected at a central part of an outer surface of the end plate of said revolving scroll, an eccentric driving pin projecting from a rotary shaft being slidably fitted into a slide groove bored through the drive bushing, and a stopper abutting against an end surface of said driving bushing so as to control tilting of the drive bushing, the stopper being provided on said eccentric driving pin.

4. A scroll type fluid machinery, comprising:

a stationary scroll and a revolving scroll having spiral wraps set up on inner surfaces of respective end plates thereof, the stationary and revolving scrolls being engaged with each other;

a drive bushing being rotatably inserted into a boss which is projected at a central part of an outer surface of the end plate of the revolving scroll;

an eccentric driving pin projecting from a rotary shaft, the eccentric driving pin being slidably fitted into a slide groove bored through the drive bushing; and means for preventing tilting of the drive bushing relative to the rotary shaft during rotation of the revolving scroll, the means for preventing comprising a gap between said eccentric driving pin and one end of said slide groove in a direction that the radius of revolution becomes larger, the gap being set to a preset very small distance $\delta$ which is based on a value, the value being determined when said revolving scroll occupies a position of theoretical radius of revolution thereof and the value being based on processing error and deformation due to temperature and pressure of the scrolls, the gap preventing tilting of the drive bushing beyond a certain amount as determined by the preset distance $\delta$.

5. The scroll type fluid machinery according to claim 4, further comprising means for enabling matter between the wraps of the scrolls to escape, the means for enabling comprising a second gap between one end of said slide groove and the eccentric driving pin, the second gap being on an opposite side of the eccentric driving pin than the gap of the means for preventing, the second gap being set at an interval which is sufficient to allow the matter between the wraps of the scrolls to escape.

6. The scroll type fluid machinery according to claim 4, further comprising a stopper abutting against an end surface of said drive bushing, the stopper being on the eccentric driving pin and controlling tilting of the drive bushing relative to the rotary shaft.

* * * * *